US008356850B1

(12) United States Patent
Starkweather et al.

(10) Patent No.: US 8,356,850 B1
(45) Date of Patent: Jan. 22, 2013

(54) SYSTEM AND METHOD FOR CARRYING AND INSTALLING A PLURALITY OF EMPTY ICE BAGS INTO AN ICE BAGGING ASSEMBLY

(75) Inventors: Harry Starkweather, Irving, TX (US); James Shaker, Wylie, TX (US); Paul Bareford, Irving, TX (US)

(73) Assignee: In-Store Bagging Machine Company, LLC, Irving, TX (US)

( * ) Notice: Subject to any disclaimer, the term of this patent is extended or adjusted under 35 U.S.C. 154(b) by 148 days.

(21) Appl. No.: 12/888,189

(22) Filed: Sep. 22, 2010

(51) Int. Cl.
*A45F 5/00* (2006.01)

(52) U.S. Cl. ..... 294/158; 16/114.1; 383/15

(58) Field of Classification Search ..... 294/158, 294/214, 137, 170; 53/410, 413, 128.1, 134.1; 383/15, 26; D9/434; D3/318; 190/117, 190/118; D25/41.1; 16/110.1, 114.1, 406, 16/422, 425, 431, 444; 224/925
See application file for complete search history.

(56) References Cited

U.S. PATENT DOCUMENTS

| | | | | |
|---|---|---|---|---|
| 3,009,336 | A | | 11/1961 | Bayston |
| 3,151,668 | A | | 10/1964 | Zimmermann |
| 3,227,358 | A | * | 1/1966 | Laguerre ..... 383/15 |
| 3,282,493 | A | * | 11/1966 | Kamins et al. ..... 383/203 |
| 3,459,362 | A | * | 8/1969 | Giachi ..... 383/15 |
| 3,528,471 | A | * | 9/1970 | Hartmann ..... 383/15 |
| 3,559,424 | A | | 2/1971 | Nelson |
| 3,654,771 | A | | 4/1972 | Kuebler |
| 3,712,019 | A | | 1/1973 | Lamka et al. |
| 3,719,307 | A | | 3/1973 | Larson |
| 3,727,374 | A | | 4/1973 | Williams |
| 3,789,570 | A | | 2/1974 | Mullins, Jr. |
| 3,807,123 | A | | 4/1974 | Kihnke |
| 3,889,449 | A | | 6/1975 | Membrino |
| 4,132,049 | A | | 1/1979 | Mullins, Jr. |
| 4,291,517 | A | | 9/1981 | Lipes |
| 4,368,608 | A | | 1/1983 | Ray |
| 4,404,817 | A | | 9/1983 | Cox, III |
| 4,541,228 | A | | 9/1985 | Petersen |
| 4,607,478 | A | | 8/1986 | Maglecic |
| 4,878,523 | A | | 11/1989 | Balsamico et al. |
| 5,070,674 | A | | 12/1991 | Lerner |
| 5,088,300 | A | | 2/1992 | Wessa |
| 5,109,651 | A | | 5/1992 | Stuart |
| 5,277,016 | A | | 1/1994 | Williams et al. |

(Continued)

FOREIGN PATENT DOCUMENTS

| | | | |
|---|---|---|---|
| ES | 2171120 | A | 8/2002 |

(Continued)

*Primary Examiner* — Dean Kramer
*Assistant Examiner* — Stephen Vu
(74) *Attorney, Agent, or Firm* — Booth Udall, PLC

(57) ABSTRACT

A handle system for carrying and installing a plurality of empty ice bags in an ice bagging assembly is disclosed herein. The handle may comprise any system for effectively transporting empty ice bags and loading the ice bags into an ice bagging assembly. Implementations of the handle system may comprise a post member and a cover member. The post member may include a handle and a plurality of posts protruding from one side of the post member. The cover member may include a cover support bar with a plurality of reentrant openings aligned with the plurality of posts when the cover member is mated with the post member. The plurality of reentrant openings that each extend through the cover member and are sized to receive a portion of one of the plurality of posts.

15 Claims, 4 Drawing Sheets

U.S. PATENT DOCUMENTS

| | | | | |
|---|---|---|---|---|
| 5,400,838 | A | | 3/1995 | Schjerven |
| 5,440,863 | A | | 8/1995 | Toya et al. |
| 5,444,962 | A | | 8/1995 | Bonnet |
| 5,458,851 | A | | 10/1995 | Schroeder et al. |
| 5,473,865 | A | | 12/1995 | Tanaka |
| 5,782,562 | A | * | 7/1998 | Anspacher ..... 383/15 |
| 5,813,092 | A | * | 9/1998 | Greenfield et al. ..... 16/425 |
| 5,822,955 | A | | 10/1998 | Woosley et al. |
| D407,092 | S | | 3/1999 | Weaver |
| 6,112,539 | A | | 9/2000 | Colberg |
| 6,354,338 | B1 | | 3/2002 | Takemoto |
| 6,474,048 | B1 | | 11/2002 | Metzger et al. |
| 6,904,946 | B2 | | 6/2005 | James |
| 7,062,892 | B2 | | 6/2006 | Metzger |
| 7,421,834 | B1 | | 9/2008 | Doolan |
| 7,426,812 | B2 | | 9/2008 | Metzger |
| 7,426,945 | B2 | | 9/2008 | Dalton et al. |
| 7,497,062 | B2 | | 3/2009 | Metzger |
| 7,624,773 | B2 | | 12/2009 | Maxwell |
| 7,681,408 | B2 | | 3/2010 | Hobson et al. |
| 2005/0051232 | A1 | | 3/2005 | Schmoll |
| 2007/0267086 | A1 | | 11/2007 | Dunn |
| 2008/0022635 | A1 | | 1/2008 | Metzger |
| 2008/0295462 | A1 | | 12/2008 | Metzger |
| 2009/0120039 | A1 | | 5/2009 | Metzger |

FOREIGN PATENT DOCUMENTS

| | | | |
|---|---|---|---|
| WO | WO0001582 | A1 | 1/2000 |

* cited by examiner

SYSTEM AND METHOD FOR CARRYING AND INSTALLING A PLURALITY OF EMPTY ICE BAGS INTO AN ICE BAGGING ASSEMBLY

BACKGROUND

1. Field of the Invention

Aspects of this document relate generally to ice bagging systems and management and loading of the empty bags used within those systems.

2. Description of Related Art

Conventional ice bagging systems generally manage empty ice bags in one of two primary ways. First, the ice bags may be attached end-to-end through a perforated portion of the bags and rolled on a spool to form a roll of empty bags which is loaded into and dispensed within an ice bagging machine. Second, ice bags, which are all attached through perforated portions at the top of the ice bags, are stacked and the perforated portions are coupled together on a wicket which is loaded vertically into an ice bagging machine. The wicket retains the top portion of the bag once the perforated portion is broken to remove the ice bag.

SUMMARY

In a first aspect, a handle system for carrying and installing a plurality of empty ice bags in an ice bagging assembly is disclosed. The handle system may comprise a post member comprising a post support bar comprising an inward side, an outward side, a handle extending from the post member substantially parallel to the inward side, and at least two hollow posts protruding from the inward side of the post member away from the outward side. The handle system may further comprise a cover member comprising a cover support bar comprising a first edge and at least two reentrant openings extending inward of the cover support bar away from the first edge, the two reentrant openings each aligned with a different one of the hollow posts on the post member when the cover member is mated with the post member, each of the reentrant openings extending through the cover member and sized to receive at least a portion of the respective different one of the hollow posts.

Particular implementations may comprise one or more of the following features. At least one hole extending through a wall of each of the hollow posts and at least one pin protruding within each of the reentrant openings toward their respective first edges. The pin within each of the reentrant openings each pin is sized to extend into the hole through each of the respective hollow posts when the cover member is mated with the post member. The hole extending through the wall on each of the hollow posts may comprise a first hole and a second hole located opposite from each other on the wall of each of the hollow posts such that the first and second holes are aligned. The at least hollow posts of the post member may comprise at least four hollow posts, and the at least two reentrant openings of the cover member comprises at least four reentrant openings. The cover member may also be left-to-right symmetrical. The hollow posts may each further comprise a tapered end distal from the post support bar. The two hollow posts may also each taper between an end coupled to the post support bar and the tapered end. The reentrant openings may further each comprise an opening, a neck, and a reentrant body. In this embodiment, the reentrant opening may narrow from the opening to the neck and then widens to form the reentrant body. The hollow posts may each also be substantially cylindrical and the reentrant bodies of each of the reentrant openings may each be substantially circular.

In another embodiment, a handle system for carrying and installing a plurality of empty ice bags in an ice bagging assembly is disclosed. This embodiment may comprise, a post member comprising a post support bar comprising an inward side, an outward side, a handle extending from the post member substantially parallel to the inward side, at least two post holes in the support bar, and at least two posts protruding from the inward side of the post member away from the outward side. The embodiment may also comprise a cover member comprising a cover support bar comprising a first edge and at least two reentrant openings extending inward of the cover support bar away from the first edge, the at least two reentrant openings each aligned with a different one of the posts on the post member when the cover member is mated with the post member, each of the two reentrant openings extending through the cover member and sized to receive at least a portion of the respective different one of the posts.

Particular implementations may comprise one or more of the following features. At least one hole may extend into each of the posts and at least one pin protruding from within each of the reentrant openings toward their respective first edges, the pin within each of the reentrant openings sized to extend into the hole into each of the respective posts when the cover member is mated with the post member. The at least two posts of the post member may comprise at least four posts, and the at least two reentrant openings of the cover member comprise at least four reentrant openings. The posts may each further comprise a tapered end distal from the post support bar. In another embodiment, the posts may each taper between an end coupled to the post support bar and the tapered end. The reentrant openings may each also comprise an opening, a neck, and a reentrant body, wherein the reentrant opening narrows from the opening to the neck and then widens to form the reentrant body.

A method of loading individually separable empty ice bags into an ice bagging assembly is also disclosed. The method may begin by aligning holes in a plurality ice bags with at least two hollow posts protruding from an inward side of a post support of member that extend away from an outward side of the post member. The hollow posts of the post member are then placed through the holes of the ice bags. At least reentrant openings that extend inward from a first edge of a cover support bar of a cover member are then aligned with the hollow posts. The hollow posts of the post member may then be placed through the reentrant openings of the cover member. The plurality of ice bags may then be carried with a handle that extends from the post member substantially parallel to the inward side. The plurality of ice bags, the cover member, and the post member may then be secured into an ice bagging assembly.

Particular implementations may comprise one or more of the following features. In another embodiment, the method may also comprise securing at least one pin protruding within each of the reentrant openings within a hole on each of the hollow posts. The method may also comprise aligning the hollow posts on outward side of the post member with at least two table posts, then placing the table posts into the hollow posts of the post member.

Aspects and applications of the inventions presented here are described below with reference to the Drawings and the Detailed Description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment, and they are not necessarily to scale.

DETAILED DESCRIPTION

In the following description, and for the purposes of explanation, numerous specific details are set forth in order to provide a thorough understanding of the various aspects of the disclosure. It will be understood, however, by those skilled in the relevant arts, that the implementations of the disclosure may be practiced without these specific details. In other instances, known structures and devices are shown or discussed more generally in order to avoid obscuring the various implementations. In many cases, a description of the operation is sufficient to enable one to implement the various forms of the disclosed implementations. It should be noted that there are many different and alternative configurations, devices and technologies to which the disclosed implementations and embodiments may be applied. The full scope of the inventions is not limited to the examples that are described below.

Figure 1:
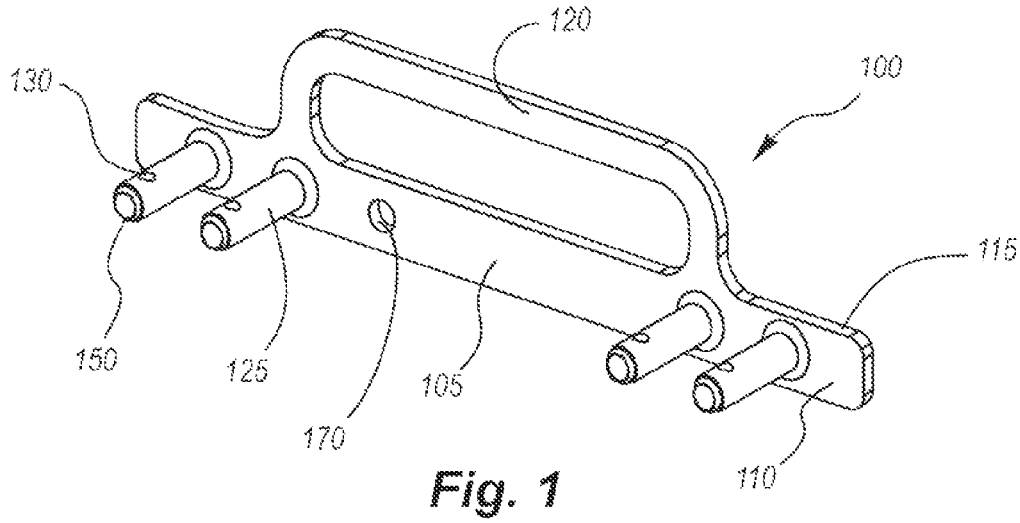
FIG. 1 depicts a perspective view of a post member for an ice bag handle.

Referring now to FIG. 1, a perspective view of a post member 100 in a handle system 298 (FIG. 3) for carrying and installing a plurality of empty ice bags in an ice bagging assembly is depicted. In the embodiment of FIG. 1, the post member 100 may comprise any system for securing ice bags to a post member 100 and ice bagging assembly. The ice bagging assembly may comprise posts that extend through holes, holes in the post member for ice bagging assembly posts, or, as is depicted in FIG. 1, hollow posts that fit around table posts and also through holes in the ice bag. The post member may comprise a post support bar 105 comprising and inward side 110, an outward side 115, a post handle 120 extending from the post member 100 substantially parallel to the inward side 110, and at least two posts 125 protruding from the inward side 110 of the post member 100, away from the outward side 115.

In various applications, the post support bar 105 holds the post member 100 together. The post support bar 105 may comprise any system for providing structure to the post member 100 to support the posts 125, such as one continuous piece of material, material coupling pieces together, and the like. In a particular embodiment, the post support bar 105 is one continuously molded material with the posts 125 and the handle 120. In another particular embodiment, the post support bar 105 includes additional apertures through it sized to receive table posts therethrough instead of or in addition to receiving table posts through the posts 125.

Figure 2:
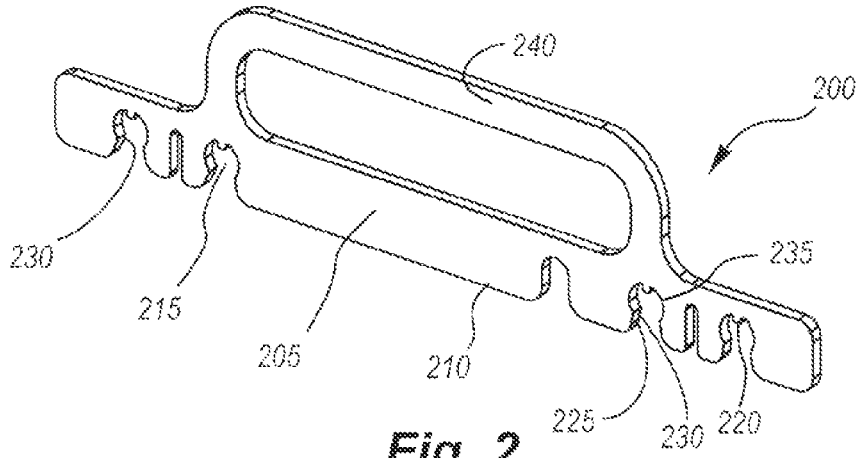
FIG. 2 depicts a perspective view of a cover member for an ice bag handle.

A particular embodiment may further comprise a post handle 120 for transporting the post member 100 and ice bags. The post handle 120 may comprise any system for holding the post member 100, whether or not ice bags are attached to the posts 125. In the particular embodiment of FIG. 1, the post handle 120 extends from the post member 100 substantially parallel to the inward side 110. For example, the post handle 120 may, in other embodiments, form a semicircle, square, oval, etc. and still be substantially parallel to the inward side 110 because its major axis is parallel to the inward side 110. Particular embodiments may further comprise a post handle 120 sized to allow various sizes of human hands to fit between the post handle 120 and the post support bar 105. In other embodiments, the post handle 120 may be sized to allow other types of machinery to fit between the post handle 120 and the post support bar 105. In still other embodiments, the post handle 120 on the post member 100 may couple to a cover handle 240 on the cover member 200 or couple to the cover member 200 itself (FIG. 2).

Particular embodiments may further comprise posts for holding a plurality of ice bags. The posts may comprise any system for securing a plurality of empty ice bags to the post member 100, such as hollow posts or solid posts. In the particular embodiment of FIG. 1, at least two hollow posts 125 protrude from the inward side 110 of the post member 100 away from the outward side 115. The hollow portion of the posts 125 in this particular embodiment begins at the end distal from the outward side and continues all the way through to an opening on the outward side 115. In other embodiments, the hollow portion may begin in an opening on the outward side 115 and continue only part way through the post or begin in an opening on the end distal from the outward side 115 and continue only part way through the post. In particular embodiments, the post member 100 may comprise at least four posts 125. The posts 125 may be separate pieces coupled to the post member 100, or they may be one continuously shaped or molded piece with the post member 100 and post handle 120. In some embodiments, the posts 125 may further be arranged such that the post member 100 is left-to-right symmetrical. For example, if two posts 125 are present on an embodiment, both posts 125 would be equal distance from the center of the post member 100; if four posts 125 are present on an embodiment, the distance of the two posts 125 from the center on a first side of the post member 100 will be equal the distance of the two posts 125 from the center of a second side of the post member 100.

The posts 125 may comprise any suitable shape that allows the posts 125 to fit within reentrant openings 215 on the cover member 200 (FIG. 2) and further allows table posts from the ice bagging assembly to fit within the hollow area, such as cylindrical, cuboid, and the like. For size, it is desirable that an outer diameter of the posts is approximately the size of the holes through the empty ice bags (FIG. 6) to restrict individual shifting movement of the bags when they are stacked, so that they will remain aligned with each other until they are installed in the ice bagging assembly. In the embodiment of FIG. 1, the posts 125 are cylindrical and sized to allow the table posts from the ice assembly fit within the hollow area of the posts 125 and extend therethrough. The posts 125 may further be comprised of any material.

The posts 125 may further comprise at least one hole 130 for holding the cover member 200 and empty ice bags 10 more securely when the cover member 200 is mated with the post member 100. The hole 130 in the post 125 may comprise any shape and any system for engaging a pin-type element. In the embodiment of FIG. 1, a hole 130 extends through a wall of each of the hollow posts 125. In other embodiments, a first hole 130 and a second hole 130 located opposite from each other on the wall of each of the hollow posts 125, such that the first and second holes 130 are aligned. In other embodiments, the holes 130 may not be aligned. In still other embodiments, any number of holes 130 can be present anywhere on the posts 125 for selective placement of the cover member 200 (FIG. 2).

In a particular embodiment, the posts may further comprise a tapered end 150 distal from the post support bar 105. The amount of tapering may vary according to the embodiment, and may result in anything from a distal end that is substantially similar in radius to the cylindrical portion of the hollow post 125, to a distal end that is substantially conical in shape. In other embodiments, tapered posts 125 may taper between an end coupled to the post support bar and the distal end of the posts. The amount of taper in the tapered posts may also vary in different embodiments.

In other embodiments, the post member 100 may comprise at least two post member holes 170 for securing the post member 100 to table posts in an ice bagging assembly. The post member holes 170 may comprise any system that allows for table posts in the ice bagging assembly to couple to the post member 100. In the embodiment of FIG. 1, the post member holes 170 extend from the inward side 110 to the outward side 115 of the post support bar 105. In other embodiments, the post member holes 170 may be in any quantity and placed anywhere on the post member 100 suitable to allow for coupling to table posts in an ice bagging assembly.

Referring now to FIG. 2, a cover member 200 in a handle system for carrying and installing a plurality of empty ice bags in an ice bagging assembly. In a particular embodiment, the handle system may further comprise a cover member 200 for securing empty ice bags to the post member 100 (FIG. 1). The cover member 200 may comprise any system for preventing empty ice bags from falling off or separating from the post member 100 (FIG. 1). In the embodiment specifically shown in FIG. 2, the cover member 200 comprises a cover support bar 205 comprising a first edge 210 and at least two reentrant openings 215 extending inward of the cover support bar 205 away from the first edge 210. Each of the two reentrant openings 215 may extend through the cover member 200 and may be aligned with a different post 125 on the post member 100 (see FIG. 1). The reentrant openings 215 may further be sized to receive at least a portion of the different posts 125.

According to various applications, the cover support bar 205 holds the cover member 200 together. The cover support bar 205 may comprise any system for providing structure to the cover member 200, such as one continuous piece of material, material coupling pieces together, and the like. In the embodiment shown in FIG. 2, the cover support bar 205 is one continuously molded material of sufficient resilient flexibility to permit the reentrant openings 215 to expand from and contract to a rest state as they are forced over the posts 125 of the post member 100 (FIG. 1).

Figure 3:
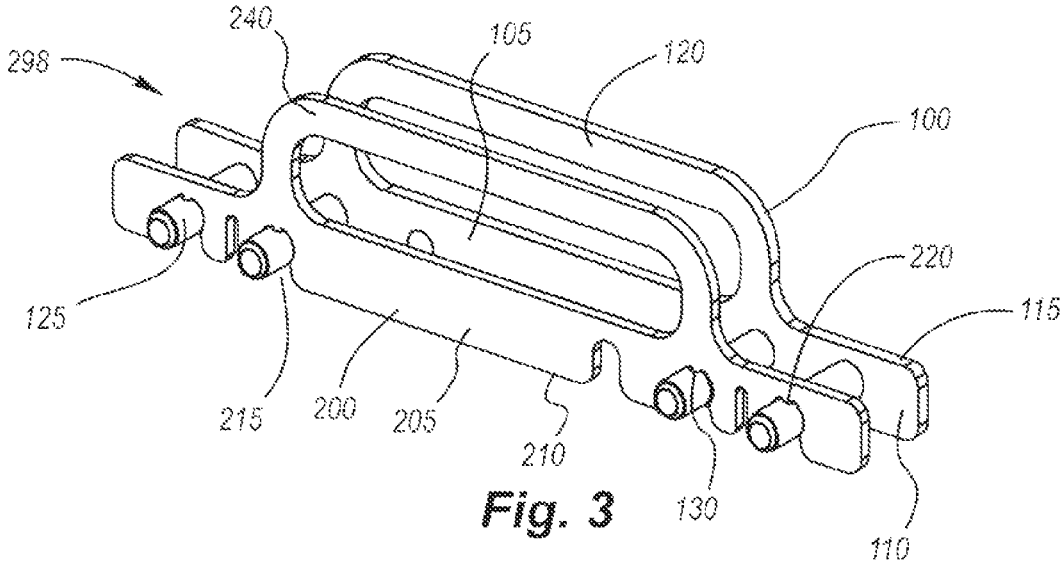
FIG. 3 depicts a perspective view of a cover member a post member mated together.

The reentrant openings 215 help secure the plurality of empty ice bags 10 between the cover member 200 and post member 100 (FIG. 1). The reentrant opening 215 may comprise any system to keep a plurality of empty ice bags 10 from sliding or falling off the posts 125 of the post member 100 (see FIG. 1), such as a pin-type holding element, tension, grooves in the posts, or the like. In a particular embodiment, at least two reentrant openings 215 are present such that the reentrant openings 215 are aligned with the solid 160 or hollow posts 125 of the post member 100 when the post member 100 and cover member 200 are mated (FIG. 3). In other embodiments, there may be at least three or more reentrant openings 215 that are respectively aligned to at least three or more posts 125 of the post member 100 (FIG. 1), or are aligned with apertures through the post member 100. In yet other embodiments, the cover member 200 may comprise any number of reentrant openings 215 that align with any number of posts 125 on the post member 100 (see FIG. 3). In some embodiments, the cover member 200 may comprise more reentrant openings 215 than posts 125 of the post member 100 with which the cover member 200 is mated. The reentrant openings 215 may be anywhere on the cover support bar 205 or cover member 200 and extend inward to any distance from the first edge 210.

Reentrant openings 215 are sized to allow the posts 125 of the post member 100 to fit within the reentrant opening 215. The reentrant openings 215 may comprise any system for receiving a post 125 (FIG. 1). In the specific embodiment illustrated in FIG. 2, the reentrant opening 215 extends through the cover member 200 and is sized to receive at least a portion of the respective post 125 from the post member 100 (FIG. 1). In some embodiments, the reentrant opening 215 may be sized such that the entire post 125 fits all through the reentrant opening 215. In other embodiments, the reentrant opening 215 may be sized such that the solid 160 or hollow post 125 only partially fits through the reentrant opening 215 due to the tapering in the post.

The reentrant opening 215 may be shaped in a variety of shapes that allow the posts 125 to fit within the reentrant opening 215. The reentrant opening 215 may also be placed such that the reentrant opening 215 aligns with post member holes 170 on the post member (FIG. 1) and shaped to allow a table post to pass through the reentrant opening 215. According to various applications, cover member may comprise reentrant openings 215 shaped to allow only table posts, only posts 125 (FIG. 1), and any combination of table posts and posts 125. In a particular embodiment, a reentrant opening 215 extends inward at an approximately ninety degree angle from first edge, with a partial-circle inside the reentrant opening. In another embodiment, a reentrant opening 215 comprises an opening 225, a neck 230, and a reentrant body 235. In this embodiment, the reentrant opening 215 narrows from the opening 225 to neck 230, and then widens to form the reentrant body 235. The reentrant body 235 may be sized receive the posts 125 of the post member 100, in any type of fit, such as loose, tight, etc. The neck 230 may be sized and resiliently flexible enough to allow one solid 160 or hollow 125 post of the post member 100 to slide through the neck 230 to the reentrant body 235. Many plastics are sufficiently strong and resilient to flex and allow for a snap-fit of the post member 100 with the cover member 200.

In another embodiment, the reentrant opening 215 may further comprise a pin 220 for attaching the cover member 200 to the post member 100 (FIG. 1). The pin 220 may comprise any system for stabilizing the handle system when the posts 125 are in the reentrant openings 215, such as a small pin protruding from within the reentrant opening, a spring pin, or long pin that goes through the posts. In the specific embodiment illustrated in FIG. 2, handle system comprises at least one pin 220 protruding from within each of the reentrant openings 215 toward the respective first edge 210. The pin 220 may be a shaped in a variety of shapes, such as circular, rectangular, triangular, arrow shaped, and the like. In the FIG. 2, pin 220 is substantially rectangular shaped. The pin 220 is sized to extend into the hole 130 on the post 125 of the post member 100 when the cover member 200 is mated with post member 100. In some embodiments, the pin 220 may extend all the way through the posts 125 of the post member 100, or, as in FIGS. 2 and 3, extend only partially into the hole 130 in the post 125 of the post member 100.

Figure 4:
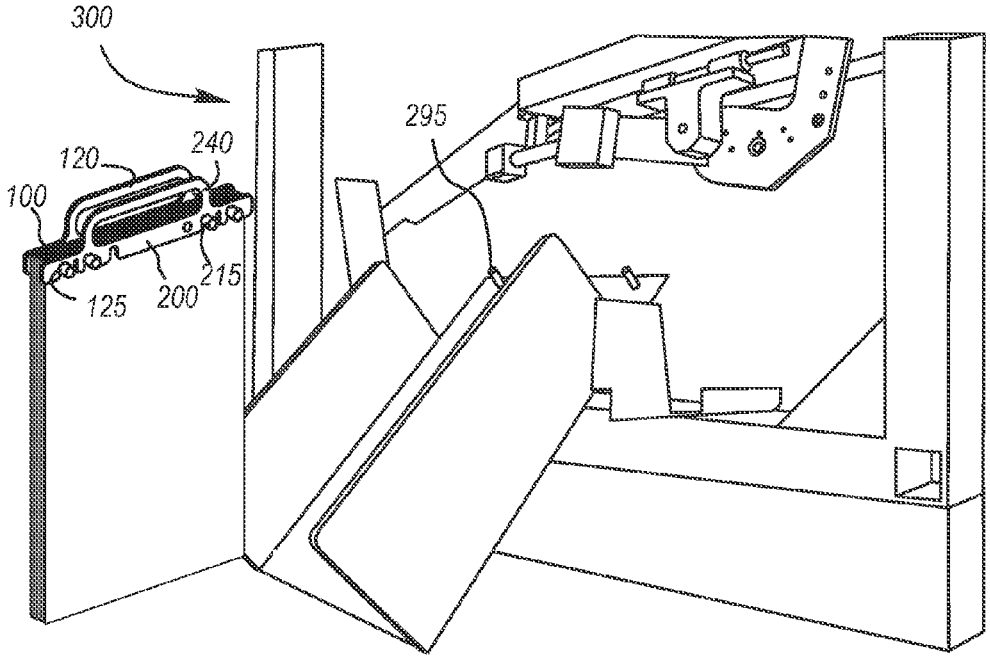
FIG. 4 depicts a perspective view of a handle assembly ready for installation in an ice bagging assembly.
Figure 5:
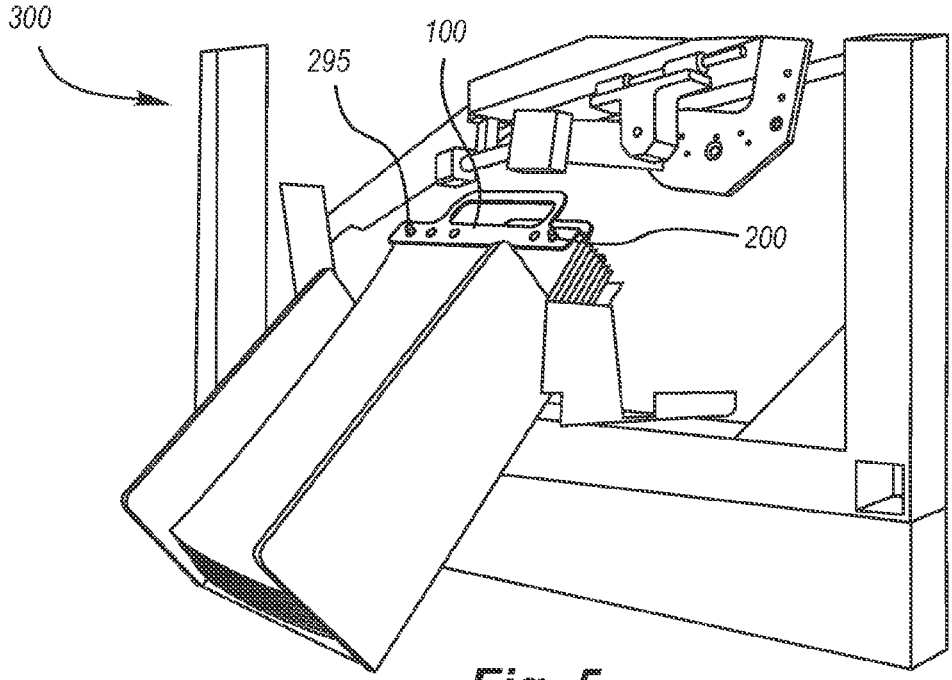
FIG. 5 depicts a perspective view of the cover member and post member of FIG. 3 coupled with a plurality of stacked ice bags.

According to various applications, the handle system may further comprise a cover handle 240 for transporting the cover member 200 and ice bags. The cover handle 240 may comprise any system for holding the cover member 200, whether or not ice bags 10 are attached to the posts 125 or the cover member 200 is engaged with the post member 100. In the embodiments of FIGS. 1-3, the cover handle 240 extends from the cover member 200 substantially parallel to an inward cover side. The cover handle 240 may form a semi-circle, square, oval, or any other polygonal shape. A particular embodiment further comprises a cover handle 240 sized to allow various sizes of human hands to fit between the cover handle 240 and the cover support bar 205. In other embodiments, the cover handle 240 may be sized to allow other types of machinery to fit between the cover handle 240 and the cover support bar 205. In still other embodiments, the cover handle 240 on the cover member 200 may couple to a post handle 120 on the post member 100 or couple to the post member 100. FIG. 3 shows a perspective view of the cover member 200 and post member 100 in a mated position as a handle assembly 298, FIG. 4 shows a perspective view of a handle assembly 298 holding a stack of individually separate ice bags 290 ready to install in an ice bagging assembly 300, and FIG. 5 shows the mated cover member 200 and post member 100 coupled with a stack including a plurality of ice bags 290 in a stack, with the ice bagging assembly 300 table posts 295 extending through the hollow posts 125 of the post member 100.

Figure 6:
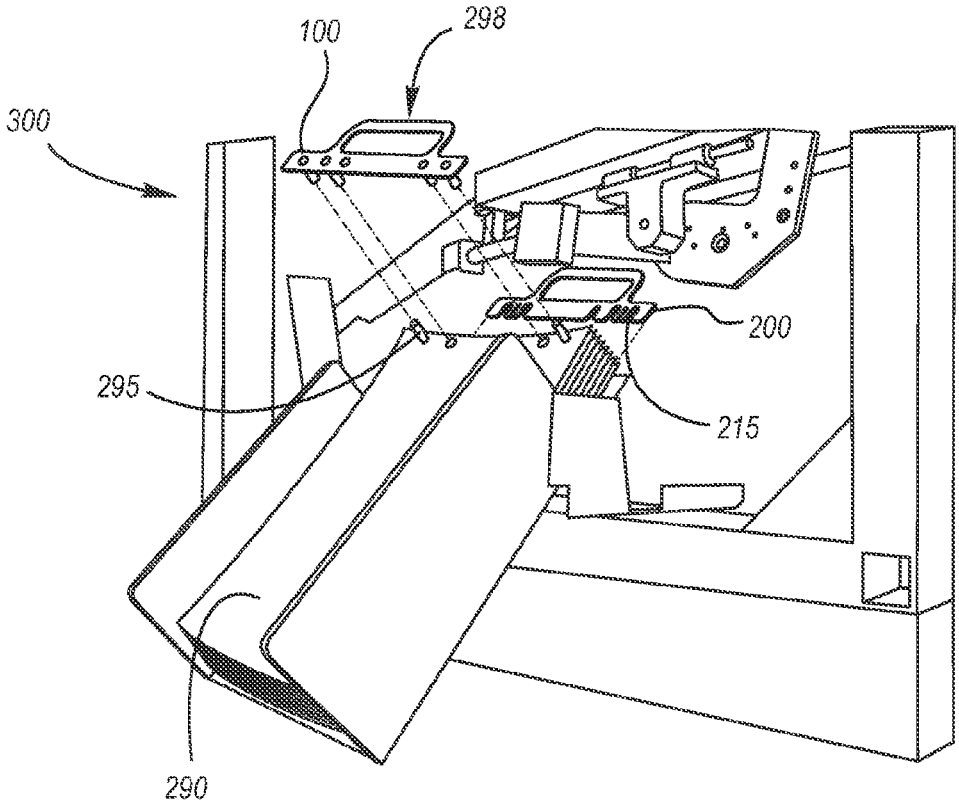
FIG. 6 depicts a perspective view of the cover member and post member of FIG. 4 being removed from the plurality of stacked ice bags.

As illustrated in FIG. 6, during installation, the cover member 200 side of the assembly coupled with the ice bags 290 is placed downward on the ice bagging assembly table with the post member 100 side of the assembly placed upward. With this orientation, the handle assembly 298 can be removed from the ice bagging assembly 300 table posts 295 without removing the plurality of ice bags 290 from the table posts 295. Due to the reentrant openings 215 of the cover member 200, the cover member 200 can be snapped-off of the post member 100 from the back side. The post member 100 can then be unthreaded from the table posts 295 from the front side without removing the ice bags 290.

Figure 7:
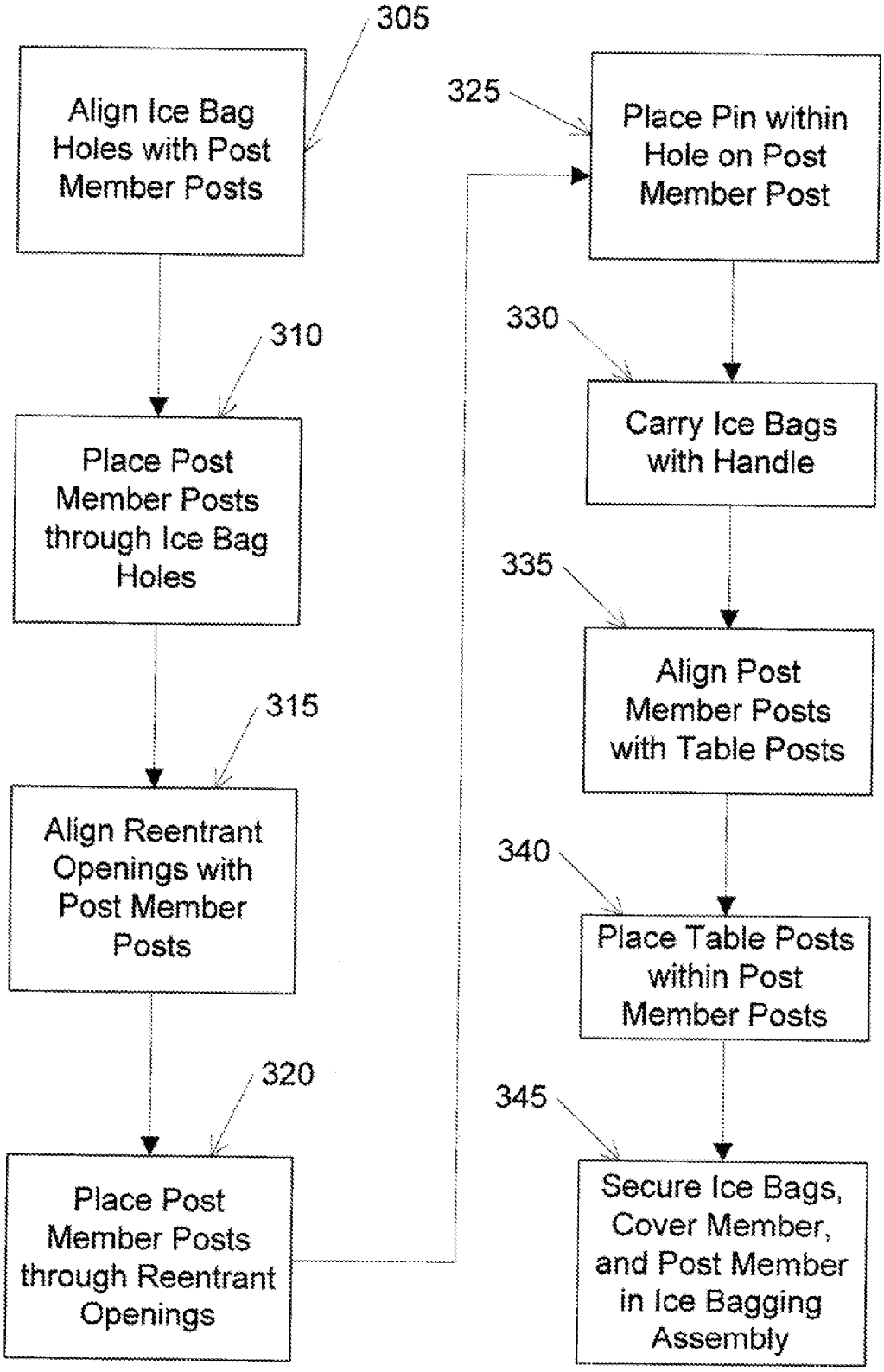
FIG. 7 is a flow chart representing a method of loading ice bags into an ice bagging assembly.

Referring now to FIG. 7, a method of loading individually separable empty ice bags into an ice bagging assembly. As illustrated in the embodiment of FIG. 7, with reference also to the specific embodiments shown in FIGS. 3 and 5, holes in the ice bags are aligned with at least two hollow posts 125 protruding from an inward side of a post support member 200 that extend away from an outward side of the post member (step 305). In various embodiments, the number of hollow posts 125 may be three, four, or more. In other embodiments, the holes in the ice bag may be aligned with at least solid posts protruding from an inward side of the post support member 200 similar to the hollow posts 125.

The solid or hollow posts 125 of the post member 200 are then placed through the holes of the ice bags (step 310). According to various applications, the hollow posts may either be pushed through the holes in the ice bags, or the ice bags may be pushed onto the solid or hollow posts such that the posts go through the holes in the ice bag.

The posts 125 are then aligned with at least two reentrant openings 215 that extend inward from a first edge of a cover support bar 105 of a cover member 100 (step 315). The reentrant openings 215 will number at least two, but may vary according to the number of posts 125 on the post member 100. In other embodiments, there may be more reentrant openings 215 on the cover member 200 than posts 125 on the post member 100.

The posts 125 of the post member 100 are then placed into a corresponding number of reentrant openings 215 (step 320). According to various applications, the posts 125 may either be pushed through the reentrant openings 215, or the cover member 200 may be pushed onto the posts 125 such that the posts 125 go through the reentrant openings 215. In other embodiments, the posts 125 may slide through a narrow neck on the reentrant opening before entering a reentrant body. Either the narrow neck or the post 125 or both may flex in enough to allow the post to pass through to the reentrant body without breaking the post or the narrow neck.

In some applications, at least one pin protruding within each of the at least two reentrant openings 215 may then be placed within a hole on each of the solid or hollow posts (step 325). The pin 220 and post hole 130 may be used to help the cover member 200 and post member 100 to more securely hold together and hold the ice bags 290 between the cover member 200 and post member 100.

The plurality of ice bags 290 may then be carried with a handle that is coupled to either post member 100 or the cover member 200 (step 330). In various embodiments, the handle may extend from either the post member 100 or cover member 200 such that the handle is substantially parallel to an inward side of either the post member 100 or the cover member 200.

In some applications, the hollow posts 125 on the inward side of the post member 100 may be aligned with at least to table posts 295 (step 335). The table posts 295 may be outside the ice bagging assembly while loading the ice bags, or already within the ice bagging assembly with the hollow posts 125 aligned with the table posts 295. The table posts 295 may then be placed into the hollow posts 125 of the post member 100 in some applications (step 340). The posts 295 may be placed into the hollow posts 125 by a variety of methods, such as a machine, pushing the hollow posts 125 onto the table posts 295, or pushing the table posts 295 into the hollow posts 125. In an embodiment with solid posts 125, the table posts 295 may be placed in post holes on the post member 100 while the solid posts 125 still extend through the holes in the ice bags 290.

The plurality of ice bags 290, the cover member 200, and the post member 100 may then be secured in an ice bagging assembly (step 345). In various embodiments, the post member 100 and the plurality of ice bags 290 may be secured in an ice bagging assembly before the cover member 200 or without cover member 200.

It will be understood that implementations are not limited to the specific components disclosed herein, as virtually any components consistent with the intended operation of a method and/or system implementation for an ice bag stack handle assembly may be utilized. Accordingly, for example, it should be understood that, while the drawing figures accompanying text show and describe particular embodiments and implementations, components may comprise any shape, size, style, type, model, version, class, grade, measurement, concentration, material, weight, quantity, and/or the like consistent with the intended operation of a method and/or system implementation for a system for carrying empty ice bag stacks.

The concepts disclosed herein are not limited to the specific implementations shown herein. For example, it is specifically contemplated that the components included in particular implementations may be formed of any of many different types of materials or combinations that can readily be formed into shaped objects and that are consistent with the intended operation of the implementations. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations, it should be readily apparent that a number of modifications may be made without departing from the spirit thereof and that these implementations may be applied to other implementations disclosed or undisclosed. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A handle system for carrying and installing a plurality of empty ice bags in an ice bagging assembly, comprising:

a post member comprising a post support bar comprising an inward side, an outward side, a handle extending from the post member substantially parallel to the inward side, and at least two hollow posts protruding from the inward side of the post member away from the outward side; and a cover member comprising a cover support bar comprising a first edge, a second edge opposite the first edge, a handle proximate the second edge, a first side extending between the first and second edges, a second side opposite the first side, and at least two reentrant openings each comprising an opening on the first edge that extends inward toward the second edge, the at least two reentrant openings each aligned with a different one of the at least two hollow posts on the post member when the cover member is mated with the post member, each of the at least two reentrant openings extending through the first and second sides of the cover member and sized to receive at least a portion of the respective different one of the at least two hollow posts.

2. The handle system of claim 1, further comprising at least one hole extending through a wall of each of the at least two hollow posts and at least one pin protruding within each of the at least two reentrant openings toward their respective first edges, the at least one pin within each of the at least two reentrant openings each pin sized to extend into the at least one hole through each of the respective at least two hollow posts when the cover member is mated with the post member.

3. The handle system of claim 2, wherein the at least one hole extending through the wall on each of the at least two hollow posts each comprises a first hole and a second hole located opposite from each other on the wall of each of the at least two hollow posts such that the first and second holes are aligned.

4. The handle system of claim 1, wherein the at least two hollow posts of the post member comprises at least four hollow posts, and the at least two reentrant openings of the cover member comprises at least four reentrant openings.

5. The handle system of claim 4, wherein the cover member is left-to-right symmetrical.

6. The handle system of claim 1, wherein the at least two hollow posts each further comprise a tapered end distal from the post support bar.

7. The handle system of claim 6, wherein the at least two hollow posts each taper between an end coupled to the post support bar and the tapered end.

8. The handle system of claim 1, wherein the at least two reentrant openings each comprise an opening, a neck, and a reentrant body, wherein the reentrant opening narrows from the opening to the neck and then widens to form the reentrant body.

9. The handle system of claim 1, wherein the at least two hollow posts are each substantially cylindrical and the reentrant body of each of the at least two reentrant openings are each substantially circular.

10. A handle system for carrying and installing a plurality of empty ice bags in an ice bagging assembly, comprising:

a post member comprising a post support bar comprising an inward side, an outward side, a handle extending from the post member substantially parallel to the inward side, at least two post holes in the support bar, and at least two posts protruding from the inward side of the post member away from the outward side; and a cover member comprising a cover support bar comprising a first edge, a second edge opposite the first edge, a handle proximate the second edge, a first side extending between the first and second edges, a second side opposite the first side, and at least two reentrant openings each comprising an opening on the first edge that extends inward towards the second edge, the at least two reentrant openings each aligned with a different one of the at least two posts on the post member when the cover member is mated with the post member, each of the at least two reentrant openings extending through the first and second sides of the cover member and sized to receive at least a portion of the respective different one of the at least two posts.

11. The handle system of claim 10, further comprising at least one hole extending into each of the at least two posts and at least one pin protruding from within each of the at least two reentrant openings toward their respective first edges, the at least one pin within each of the at least two reentrant openings sized to extend into the at least one hole into each of the respective at least two posts when the cover member is mated with the post member.

12. The handle system of claim 10, wherein the at least two posts of the post member comprise at least four posts, and the at least two reentrant openings of the cover member comprise at least four reentrant openings.

13. The handle system of claim 10, wherein the at least two posts each further comprise a tapered end distal from the post support bar.

14. The handle system of claim 13, wherein the at least two posts each taper between an end coupled to the post support bar and the tapered end.

15. The handle system of claim 10, wherein the at least two reentrant openings each comprise an opening, a neck, and a reentrant body, wherein the reentrant opening narrows from the opening to the neck and then widens to form the reentrant body.

* * * * *